US008096282B2

(12) United States Patent
Franks et al.

(10) Patent No.: US 8,096,282 B2
(45) Date of Patent: Jan. 17, 2012

(54) METHOD FOR REDUCING MISFIRE IN AN INTERNAL COMBUSTION ENGINE

(75) Inventors: Kerry D. Franks, Chelsea, MI (US); William R. de Weever, Canton, MI (US); Luis J. Del Rio, Ann Arbor, MI (US); Kenneth A. Raupp, Ann Arbor, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 123 days.

(21) Appl. No.: 12/146,527

(22) Filed: Jun. 26, 2008

(65) Prior Publication Data

US 2009/0326789 A1 Dec. 31, 2009

(51) Int. Cl.
*F02P 5/00* (2006.01)

(52) U.S. Cl. ..... 123/406.14; 123/406.27

(58) Field of Classification Search ..... 123/406.14, 123/436, 406.27, 406.16, 406.21, 406.29, 123/406.34, 406.37, 406.38, 406.39, 479, 123/481, 690; 701/103, 104, 107; 73/35.01, 73/114.02; 60/737, 752

See application file for complete search history.

(56) References Cited

U.S. PATENT DOCUMENTS

| | | | | |
|---|---|---|---|---|
| 4,366,793 | A * | 1/1983 | Coles | 123/436 |
| 4,372,269 | A | 2/1983 | Coles | |
| 4,829,963 | A * | 5/1989 | Oblaender et al. | 123/436 |
| 4,932,379 | A * | 6/1990 | Tang et al. | 123/436 |
| 5,720,261 | A | 2/1998 | Sturman et al. | |
| 5,735,246 | A * | 4/1998 | Vincent et al. | 123/436 |
| 6,283,108 | B1 | 9/2001 | Matsufuji et al. | |
| 7,234,446 | B2 * | 6/2007 | Toyoda | 123/406.14 |
| 7,240,856 | B2 | 7/2007 | Abe | |
| 2006/0054132 | A1 * | 3/2006 | Uchiyama | 123/299 |
| 2007/0084442 | A1 * | 4/2007 | Nakagawa et al. | 123/406.27 |

* cited by examiner

*Primary Examiner* — Stephen K. Cronin
*Assistant Examiner* — Sizo Vilakazi
(74) *Attorney, Agent, or Firm* — Ralph E. Smith

(57) ABSTRACT

The present invention is a method for reducing misfire in a cylinder of an internal combustion engine. The method includes detecting a misfire event frequency that is equal to or greater than a first predetermined value, determining a pulse-width signal for a fuel injector associated with the cylinder during the misfire event, increasing the pulse-width signal if the misfire event is frequency is below a second predetermined value, and reducing the increase in the pulse-width signal if the misfire event frequency is below the first predetermined value.

13 Claims, 3 Drawing Sheets

METHOD FOR REDUCING MISFIRE IN AN INTERNAL COMBUSTION ENGINE

FIELD OF THE INVENTION

The present invention relates to reducing misfire in a cylinder of an internal combustion engine, and more particularly to reducing misfire by controlling fuel injector signal pulse-width.

BACKGROUND OF THE INVENTION

Engine misfire is a fault in the operation of an internal combustion engine, such as typically used in motor vehicles, wherein an air-fuel charge fails to ignite inside the engine cylinder's combustion chamber. In some cases engine misfire may manifest itself as engine stumble, rough idle, and/or vehicle emission control system malfunction. Engine misfire will typically trigger illumination of a malfunction indicator lamp (MIL) on the vehicle's instrument panel, which serves as a warning and a reminder that the vehicle requires servicing and repair.

Correct proportion of fuel and air inside the combustion chamber at time of cylinder firing is required to avoid engine misfire. In a modern internal combustion engine, correct proportion of fuel and air for a specific engine speed and load is determined by precise metering and supply of fuel. Fuel is typically delivered to the combustion chamber by opening an electromechanical fuel injector in response to a control signal of specified duration, i.e. of predetermined pulse-width. Control signal pulse-width is typically programmed to follow a mathematical curve or algorithm determined to provide adequate engine performance. Typically, to achieve a correct proportion of fuel and air at lower engine speeds and loads, particularly at idle, a smaller pulse-width control signal directs an injector to open briefly in order to deliver a smaller amount of fuel.

At times, response of a fuel injector may not properly correspond to the signal pulse-width due to the injector's internal mechanical hysteresis, i.e. friction associated with injector's moving components. During small pulse-width operation, the magnitude of such internal hysteresis may be significant enough that the injector is unresponsive because it remains in a closed position or is slow to open. An unresponsive injector may prevent the proper amount of fuel from being delivered to the combustion chamber, and thus cause the respective cylinder to misfire.

SUMMARY OF THE INVENTION

The present invention provides an arrangement for reducing engine misfire in an internal combustion engine.

In accordance with one aspect, a method is provided for reducing engine misfire that includes detecting a misfire event frequency occurring in a cylinder of the engine that is equal to or greater than a first predetermined value. The method also includes determining a pulse-width signal for a fuel injector associated with the cylinder during the misfire event. Furthermore, the method includes determining whether the determined pulse-width signal is in the region of operation where the injector may deliver an improper amount of fuel. Additionally, the method includes increasing via the electronic control unit the pulse-width signal for the fuel injector if the misfire event frequency is below a second predetermined value. Finally, the method includes reducing the increase in pulse-width signal to return to the determined pulse-width signal if the misfire event frequency is below the first predetermined value.

The method may additionally include reducing the increase in pulse-width signal if the misfire event frequency is greater than the second predetermined value. The method may also include retaining the increase in pulse-width signal if the misfire event frequency is between the first predetermined value and the second predetermined value. The present method may require that certain enablement conditions be satisfied, such as that coolant temperature of the engine be in a stable engine operating range and that no fuel injector fault codes have been detected. Increasing the pulse-width signal and reducing the increase may be made in incremental steps, and the incremental steps for increasing may be greater than the incremental steps for reducing. The region of operation where the injector may deliver an improper amount of fuel may correspond either to engine idle or to engine at part-throttle and low load.

It should be understood that the detailed description and specific examples which follow, while indicating preferred embodiments of the invention, are intended for purposes of illustration only and are not intended to limit the scope of the invention.

DETAILED DESCRIPTION

Figure 1A:
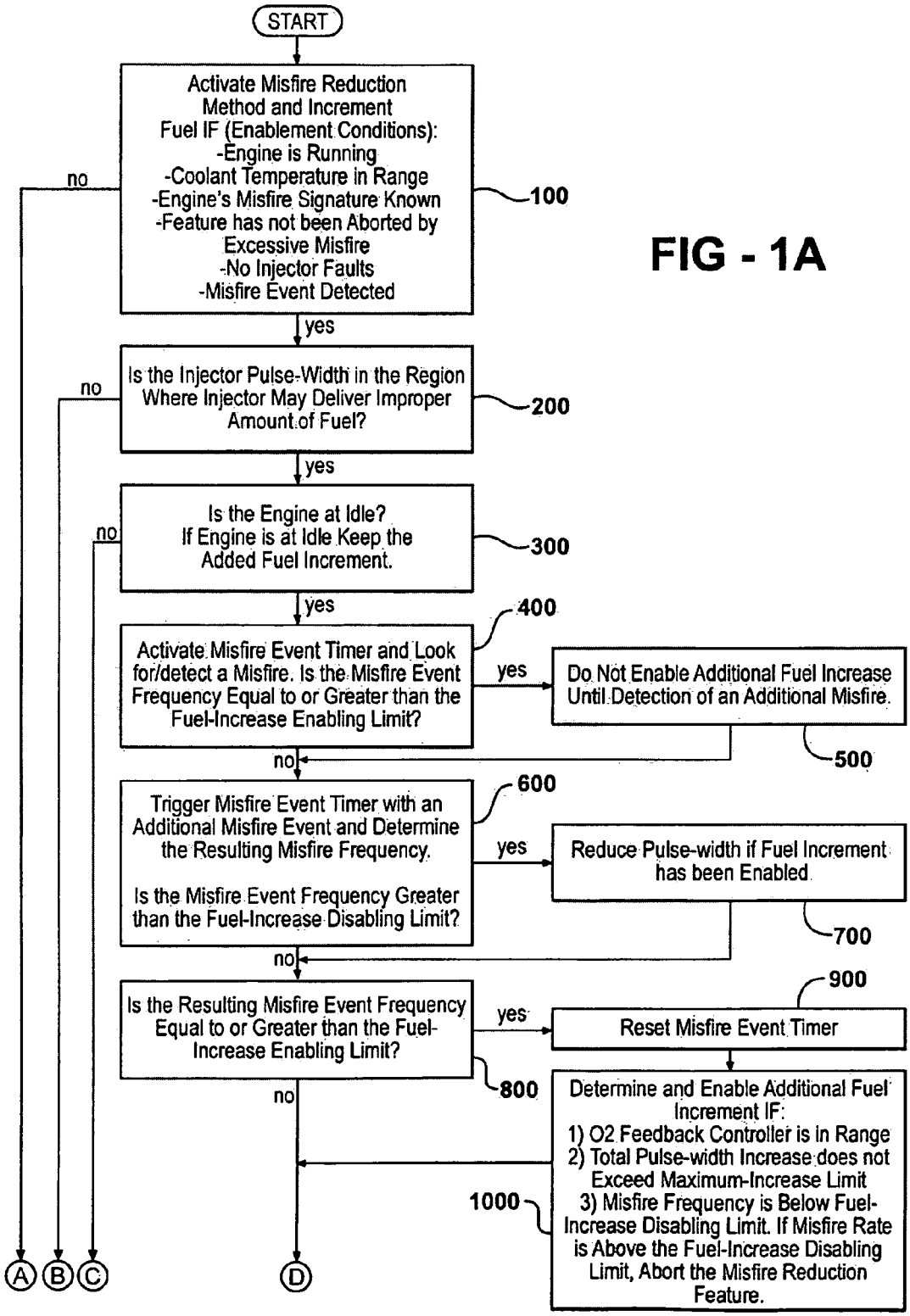
FIG. 1 is a flow diagram illustrating a method for reducing fuel injector hysteresis induced cylinder misfire according to the invention.
Figure 1B:
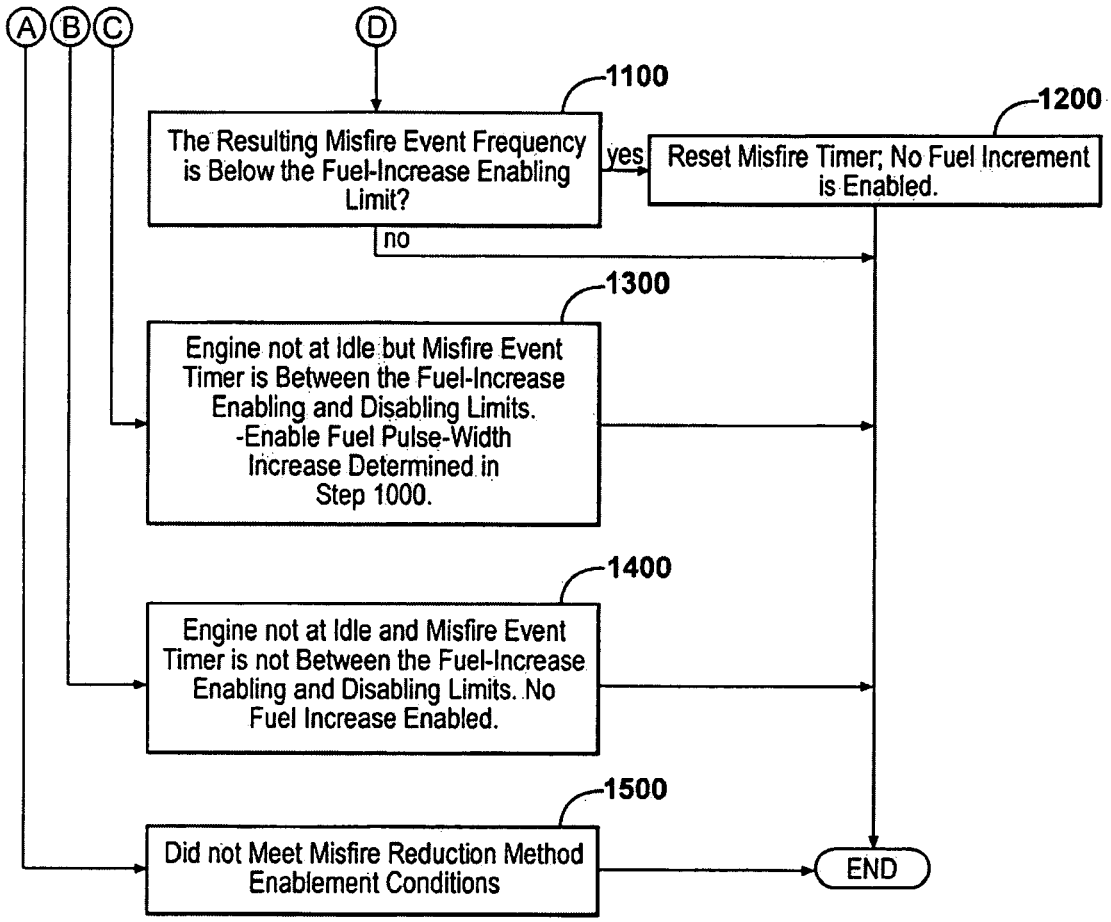

Referring to the drawings in which like elements of the invention are identified with identical reference numerals throughout, FIG. 1 generally illustrates a method by which misfire frequency due to fuel injector hysteresis may be reduced. The misfire reduction method may be incorporated into software of an electronic control unit (ECU) to provide a comprehensive program for controlling engine operation. According to the invention, the ECU is programmed to ascertain a particular engine's misfire signature, i.e. a change in engine's performance and its operating parameters in response to a misfire, when the engine is newly installed in a vehicle. With an engine installed and run in a vehicle for the first time, the engine's misfire signature is ascertained in a coast-down mode, i.e. vehicle decelerating with engine at closed throttle, by shutting off fuel delivery to each of its cylinders. Once the engine's misfire signature has been ascertained, the method is activated by the ECU every time an engine is re-started and every 10 milliseconds when the engine is running.

Whenever a misfire is detected, the ECU determines a baseline pulse-width signal for the injector associated with the misfiring cylinder. Generally, misfire events can be detected once per engine revolution. Numerous arrangements are known and suitable for detecting a misfire event. A misfire event timer may be used to establish a time elapsed between detected misfire events. The ECU may subsequently be used to determine a misfire frequency based on the established elapsed time between detected misfires.

The method is activated in block 100 with the ECU determining whether certain enablement conditions have been satisfied. The enablement conditions can include a verification that the engine is running, its misfire signature has been ascertained, its coolant temperature is in a stable operating, range and a misfire event was detected. In block 100, the enablement conditions could also include determination that the misfiring cylinder's fuel injector malfunction is unrelated to injector hysteresis. Additionally, the enablement conditions may include a verification that excessive misfire is not present, which could otherwise abort, i.e. deactivate, the method. If all the enablement conditions are not satisfied the method proceeds to block 1500 and is deactivated.

Whether the fuel injector of the misfiring cylinder is in the region of operation where the injector is likely to deliver an improper amount of fuel is determined in block 200. Generally, a fuel injector is in the region of operation where it is likely to deliver an improper amount of fuel while responding to an ECU signal of small pulse-width. Such small pulse-width injector operation typically takes place when the engine is operating at idle or under a low load at part-throttle. If block 200 is not satisfied, the method proceeds to block 1400, where it is concluded that the baseline pulse-width signal is outside the region of operation where an injector may deliver an improper amount of fuel, following which the method is deactivated. If block 200 is satisfied, the method proceeds to block 300 where the injector's baseline pulse-width signal is determined, and then the pulse-width increased, i.e. incremented, if the engine is operating at idle. If it is concluded that the engine is not at idle but is operating at part-throttle and low load, the method proceeds to block 1300 where a fuel increase is enabled with an increment determined in block 1000, following which the method is deactivated.

In blocks 400-900 it is generally ascertained whether the misfire event frequency is between a first predetermined value, i.e. fuel-increase enabling frequency limit, and a second predetermined value, i.e. fuel-increase disabling frequency limit. Typically, the first predetermined value and the second predetermined value are each determined during engine calibration and testing. The pulse-width increment feature is enabled at and above the first predetermined value in order to limit prolonged improper engine operation and avoid possible engine damage. The pulse-width increment feature is disabled above the second predetermined value because misfire frequencies exceeding the second predetermined value are typically caused by concerns unrelated to injector hysteresis. In such a case the ECU illuminates a malfunction indicator lamp (MIL) on an instrument panel of the vehicle, thereby indicating the existence of an unresolved issue possibly requiring service.

More specifically, in block 400 the misfire event timer is activated to establish the time elapsed between detected misfire events, and the misfire event frequency is determined. If the misfire event frequency is equal to or greater than the first predetermined value, the method proceeds to block 500. In block 500 further fuel increase is disabled unless an additional misfire event has been detected. If the misfire event frequency is below the first predetermined value the method proceeds to block 600. In block 600 the misfire event timer is triggered by an additional detected misfire (with the time elapsed between detected misfire events again established) and whether the resulting misfire event frequency is greater than the second predetermined value is ascertained. If the resulting misfire frequency is greater than the second predetermined value, the method proceeds to block 700, where a fuel increase is reduced if one has already been enabled. If the resulting misfire frequency is not greater than the second predetermined value the method proceeds to block 800.

Blocks 800-1000 operate as an idle increment determination loop, where it is determined whether an additional increment should be enabled, thereby further adding to the increase in pulse-width, for a misfire detected during engine idle. More specifically, in block 800 it is ascertained whether the resulting misfire frequency is greater than the first predetermined value. If the resulting misfire frequency is greater than the first predetermined value the method proceeds to block 900, where the misfire event timer is reset. In block 1000 an additional fuel increment is enabled and registered by the ECU if three conditions are satisfied. The first condition is that an ECU-run oxygen sensor feedback fuel controller must be able to maintain proper exhaust emissions. Generally, proper exhaust emissions can be maintained by sustaining a stoichiometric or near-stoichiometric fuel-air ratio of the combustion mixture. The second condition is that a total pulse-width increase, i.e. the additionally determined increment plus any previously enabled pulse-width increase, must not exceed a predetermined maximum-increase limit. The third condition is that the misfire frequency must remain below the second predetermined value.

The predetermined maximum pulse-width signal may be indicative of a specific amount of fuel which will support proper engine operation and a predetermined maximum exhaust gas emissions value at a given engine speed and load. If the implemented pulse-width increase reduces the misfire event frequency below the first predetermined value, the pulse-width signal increase is reduced, thereby returning the signal to the baseline pulse-width. Pulse-width increments for misfire events which satisfy the enablement conditions and occur during engine idle are thus specifically determined and enabled in block 1000.

Pulse-width increments are not specifically determined during part-throttle operation because a number of engine parameters, e.g. engine speed and load, continuously change and thus impact engine operation. Such continuously changing parameters complicate determination of a precise pulse-width increment for each particular part-throttle condition. However, testing has established that for a low load part-throttle misfire a pulse-width increment determined during the most recent idle event can provide a workable and reliable fuel increase. Therefore, in block 1300 a pulse-width increment that was determined and registered during block 1000 for the most recent idle event is selected and enabled for a low load part-throttle misfire event which satisfies the enablement conditions.

In block 110 it is determined whether the resulting misfire event frequency is below the first predetermined value. If the misfire frequency is above the first predetermined value the method is deactivated. If the resulting misfire is below the first predetermined value the method proceeds to block 1200. In block 1200 the misfire event timer is reset but no fuel increment is enabled, following which the method is deactivated. The method is similarly deactivated upon the completion of any of the previously described blocks 1300, 1400 and 1500. According to the invention, the method may be re-activated 10 milliseconds following its deactivation in any of the steps above.

Figure 2:
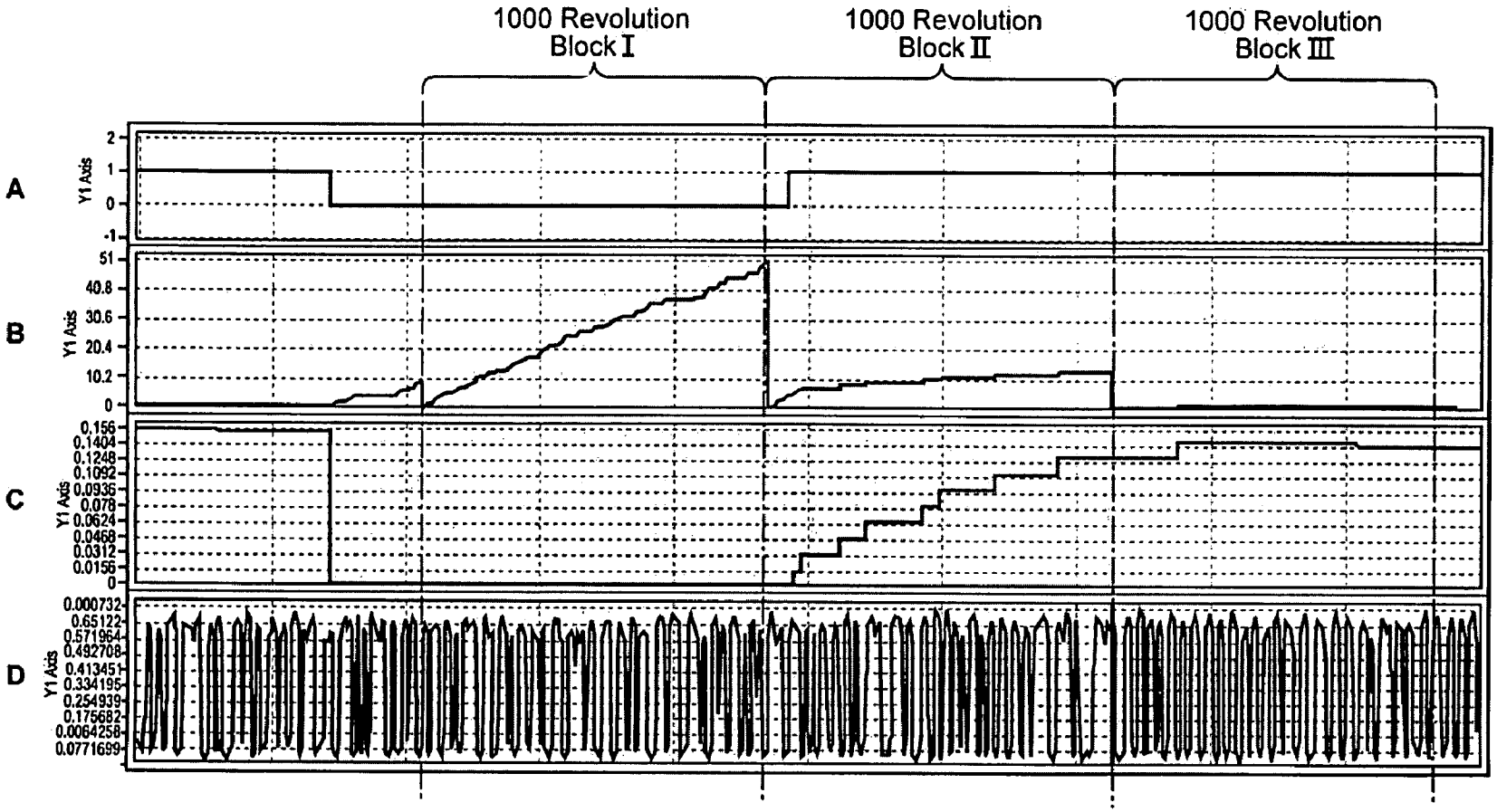
FIG. 2 includes Charts A-D graphically illustrating the misfire reduction method in an exemplary operation, where engine misfire induced by injector hysteresis is being successfully reduced, according to the invention

Charts A-D in FIG. 2 graphically illustrate the misfire reduction method in an exemplary operation, where engine misfire induced by injector hysteresis is being successfully reduced. Generally, Charts A-D are graphical plots illustrating reduction and elimination of misfire during the course of three 1000 engine revolution blocks, 1000 Revolution Block I, 1000 Revolution Block II and 1000 Revolution Block III, as a result of the method being enabled. Chart A demonstrates 1000 Revolution Block I where the misfire reduction method is dormant. During the same 1060 Revolution Block I, the misfire event timer is shown initially displaying zero misfires but then quickly ramping up to 51 registered misfire events (Chart B). Chart C demonstrates the injector pulse-width increase feature being inactive throughout 1000 Revolution Block I.

In 1000 Revolution Block. I the misfire reduction method is activated (shown in Chart A), the timer is reset, and the misfire timer registers thirteen misfire events (shown in Chart B). Chart C shows the injector pulse-width being increased during 1000 Revolution Block II in eight 0.0156 millisecond increments, up to a total pulse-width increase of 0.1248 milliseconds. The method is shown enabling one increment for each misfire event displayed in 1000 Revolution Block II of Chart B.

In 1000 Revolution Block III the misfire reduction method remains enabled (Chart A), the misfire counter registers just one misfire (Chart B) and the pulse-width is increased by an additional 0.0156 millisecond increment up to a total 0.1404 millisecond increase (Chart C). In Chart B 1000 Revolution Block III shows the misfire event timer not registering any misfires following one detected misfire, and a 0.0052 millisecond increment being subtracted from the pulse-width in Chart C. During 1000 Revolution Blocks I, II and III, the oxygen sensor feedback controller registers a near-stoichiometric composition of exhaust gas (shown in Chart D). As previously described, the exhaust gas composition is purposefully kept at or near stoichiometric value via the oxygen sensor feedback controller in order to regulate engine combustion and maintain proper exhaust gas emissions.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for reducing engine misfire events in an internal combustion engine having at least one cylinder, a fuel injector associated with each cylinder and an electronic control unit providing control signals to open and close each fuel injector, said method comprising:

i) determining whether a frequency of misfire events detected in a given cylinder of said engine during a given time period is equal to or greater than a first predetermined calibration value;

ii) determining a pulse-width of the control signal for the fuel injector associated with the cylinder during the given time period;

iii) determining whether the determined pulse-width corresponds to an engine operating state where the fuel injector may be delivering an improper amount of fuel;

iv) increasing via the electronic control unit the pulse-width of the control signal for the fuel injector if the frequency of misfire events detected during the given time period is within a range defined by the first predetermined calibration value and a second, higher, predetermined calibration value; and v) reducing the increase in pulse-width if the frequency of misfire events detected in a subsequent time period is less than the first predetermined calibration value.

2. The method of claim 1 wherein the electronic control unit further comprises a misfire event timer for detecting the frequency of misfire events.

3. A method for reducing engine misfire events in an internal combustion engine having at least one cylinder, a fuel injector associated with each cylinder and an electronic control unit providing control signals to open and close each fuel injector, said method comprising:

i) determining whether a frequency of misfire events detected in a given cylinder of said engine during a given time period is equal to or greater than a first value determined during engine calibration or testing;

ii) determining a pulse-width of the control signal for the fuel injector associated with the cylinder during the given time period;

iii) determining whether the determined pulse-width corresponds to an engine operating state where the fuel injector may be delivering an improper amount of fuel;

iv) increasing via the electronic control unit the pulse-width of the control signal for the fuel injector if the frequency of misfire events detected during the given time period is within a range defined by the first value and a second, higher, value determined during engine calibration or testing; and v) reducing, the increase in pulse-width if the frequency of misfire events detected in a subsequent time period is less than the first value or greater than the second value.

4. The method of claim 3 further comprising maintaining the increase in pulse-width if the frequency of misfire events detected is between the first value and the second value.

5. The method of claim 1 further comprising detecting a coolant temperature of the engine and increasing the pulse-width if the coolant temperature is in a stable operating range.

6. The method of claim 1 comprising detecting a fault code for the fuel injector and wherein pulse-width is not increased if the fault code has been detected.

7. The method of claim 1 wherein the engine comprises more than one cylinder, and detecting the frequency of misfire events includes identifying a misfiring cylinder.

8. The method of claim 1 wherein the engine operating state where the fuel injector may be delivering an improper amount of fuel corresponds to engine idle.

9. The method of claim 1 wherein the engine operating state where the fuel injector may be delivering an improper amount of fuel corresponds to engine operation at part-throttle and low load.

10. The method of claim 1 wherein the pulse-width is increased in incremental steps.

11. The method of claim 10 wherein the pulse-width is reduced in incremental steps and reducing steps are smaller than increasing steps.

12. The method of claim 1, wherein if multiple misfire events are detected during the given time period, the pulse-width of the control signal for the fuel injector is increased each time a misfire event is detected.

13. The method of claim 3, wherein if multiple misfire events are detected during the given time period, the pulse-width of the control signal for the fuel injector is increased each time a misfire event is detected.

* * * * *